United States Patent [19]

Jespersen et al.

[11] Patent Number: 4,673,899

[45] Date of Patent: Jun. 16, 1987

[54] H-PLANE STACKED WAVEGUIDE POWER DIVIDER/COMBINER

[75] Inventors: Nils V. Jespersen, Lansdale, Pa.; John P. Quine, Albany, N.Y.

[73] Assignee: General Electric Company, Fairfield, Conn.

[21] Appl. No.: 779,375

[22] Filed: Sep. 23, 1985

[51] Int. Cl.[4] ..... H01P 5/12

[52] U.S. Cl. ..... 333/137; 333/251

[58] Field of Search ..... 330/286, 295; 333/124, 333/125, 127, 128, 137, 251

[56] References Cited

U.S. PATENT DOCUMENTS

| | | | |
|---|---|---|---|
| 3,582,813 | 6/1971 | Hines | 333/34 X |
| 3,775,694 | 11/1973 | Quine | 333/251 X |
| 4,590,446 | 5/1986 | Hsu et al. | 333/125 |
| 4,598,254 | 7/1986 | Saito et al. | 333/125 X |

*Primary Examiner*—Paul Gensler

*Attorney, Agent, or Firm*—Clement A. Berard, Jr.; Robert L. Troike

[57] ABSTRACT

A compact waveguide power combiner/divider is characterized by low reflection and dissipation losses. The device includes a radial waveguide having an inlet opening and a plurality of radial outlet openings, and a coupling pin is arranged in the radial waveguide to couple energy from the inlet opening with the radial waveguide. A mode suppression device is connected with the radial waveguide and contains a plurality of radially arranged slots corresponding with the outlet openings. A tuning mechanism arranged within the radial waveguide optimizes the coupling of undesired modes with the slots. An undesired mode absorption device is arranged in cooperation with the slots of the mode suppression device so that undesired modes are isolated from desired modes with low reflection and dissipation losses.

19 Claims, 10 Drawing Figures

FIG. 6a
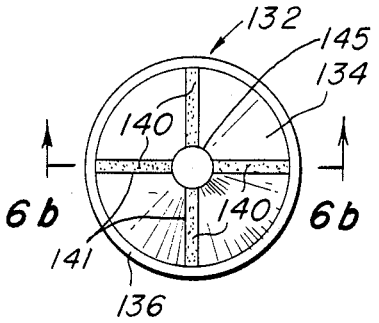
FIG. 7a
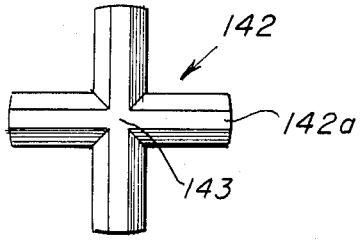
FIG. 6b
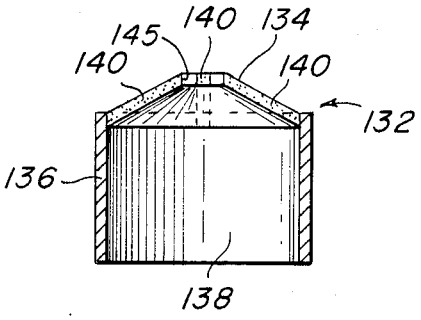
FIG. 7b
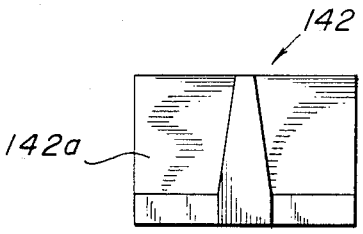
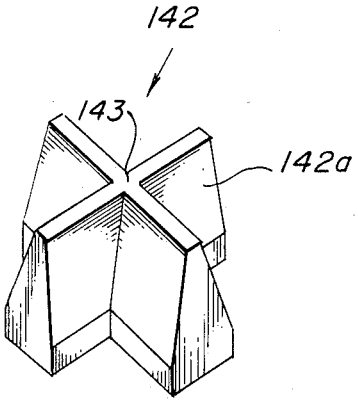
FIG. 7c

H-PLANE STACKED WAVEGUIDE POWER DIVIDER/COMBINER

BACKGROUND OF THE INVENTION

The present invention relates to a compact N-way waveguide power divider or combiner with low reflection and dissipation losses for the desired mode. The device is for use as part of the corporate feed of an active aperture antenna for 20–40 GHz operation.

BRIEF DESCRIPTION OF THE PRIOR ART

Power divider/combiners are well known in the patented prior art as evidenced by the U.S. patents to Harp et al U.S. Pat. No. 4,238,747, Hines U.S. Pat. No. 3,582,813, Quine U.S. Pat. No. 3,775,694, Quine U.S. Pat. No. 4,291,278, and Schellenberg et al U.S. Pat. No. 4,234,854. The Harp et al patent, for example, discloses a mode filter apparatus in a power combiner wherein a plurality of radially positioned resonant slots on the bottom of the filter cavity prevent unwanted modes. The Hines patent teaches a microwave power combiner for combining radio frequency energy from a plurality of sources into a single transmission line. Deep slots in a sectored sole plate are cut in a radial direction and are filled with a resistive lossy material such that the slots separate the plate into a plurality of sectors. For unison mode, with radial propagation and symmetry, no RF voltage appears across the slots and there is no dissipation of the RF wave. For all other modes involving phase variations around the circumference of the plate, there must be propagation across the slots resulting in strong power absorption and suppression of these modes.

The Quine '694 patent discloses a radial waveguide hybrid coupler power combiner comprising first and second radial waveguides. A common central plate contains a plurality of radial slots for absorbing higher order waves. These undesired modes are coupled through the slots to external regions containing a mode absorber material. Similarly, the Quine '278 patent discloses a microwave power combiner in which undesired higher order modes are absorbed by high resistance metallization strips.

Finally, the Schellenberg et al patent teaches an amplifier with a radial line divider/combiner in which isolation is achieved between laterally adjacent radial sectors using thin film isolation resistors.

While the prior devices normally operate satisfactorily, they each suffer the inherent drawback in that some undesired modes are transmitted through the waveguide.

A conical coaxial waveguide combiner is disclosed in the Quine et al article entitled "Ku-Band IMPATT-Amplifiers and Power Combiners," 1978 IEEE MTT-S International Microwave Symposium Digest, Ottawa, Canada, p. 346–348. The conical waveguide includes a plurality of radial slots partially filled with absorbing material for isolating undesirable modes. The primary drawback of the conical waveguide combiner is that it does not provide a compact configuration necessary for use as part of the feed of an active aperture antenna.

The subject invention was developed in order to overcome these and other drawbacks of the prior art by providing a compact waveguide power divider or combiner with low reflection and dissipation loss for the desired mode.

SUMMARY OF THE INVENTION

Accordingly, it is a primary object of the present invention to provide a compact waveguide power combiner/divider including a rectangular input waveguide, a plurality of rectangular output waveguides, and a radial waveguide connecting the input waveguide with the output waveguides. More particularly, the radial waveguide includes an inlet opening connected with the input waveguide and a plurality of radial outlet openings connected with the output waveguides, respectively. A coupling pin is axially arranged within the radial waveguide for coupling the input waveguide with the radial waveguide. The radial waveguide includes a mode suppression device containing a plurality of radially arranged slots corresponding with the plurality of outlet openings, respectively. A tuning element arranged within the radial waveguide optimizes the coupling of undesired modes with the slots, whereby undesired modes are isolated from desired modes with low reflection and dissipation losses.

According to a more specific object of the invention, the output waveguides, the radial waveguide, and the input waveguide are arranged in a stacked configuration with the output waveguides arranged in a circular array with coplanar H-planes.

According to a further object of invention, the tuning device comprises a capacitive ring coaxially arranged relative to the coupling pin and spaced from the radial waveguide bottom wall. Alternatively, the tuning device may comprise a plurality of capacitive pins.

According to yet another object of the invention, the mode suppression device includes a conical top wall containing the radial slots and a central opening for receiving the coupling pin. The device further includes a cylindrical side wall defining a chamber for receiving a spoked insert member molded from lossy material for absorbing undesired modes from said slots. The spokes of the insert member correspond in number with and extend radially between the slots, respectively.

BRIEF DESCRIPTION OF THE DRAWINGS

Other objects and advantages of the subject invention will become apparent from a study of the following specification, in which:

FIGS. 6*a* and 6*b* are top and front sectional view, respectively, of the mode suppression device of the waveguide of FIG. 5; and FIGS. 7*a*, 7*b*, and 7*c* are top, front, and orthogonal views of the absorbing insert for the mode suppression device of FIG. 6.

DETAILED DESCRIPTION

Figure 1:
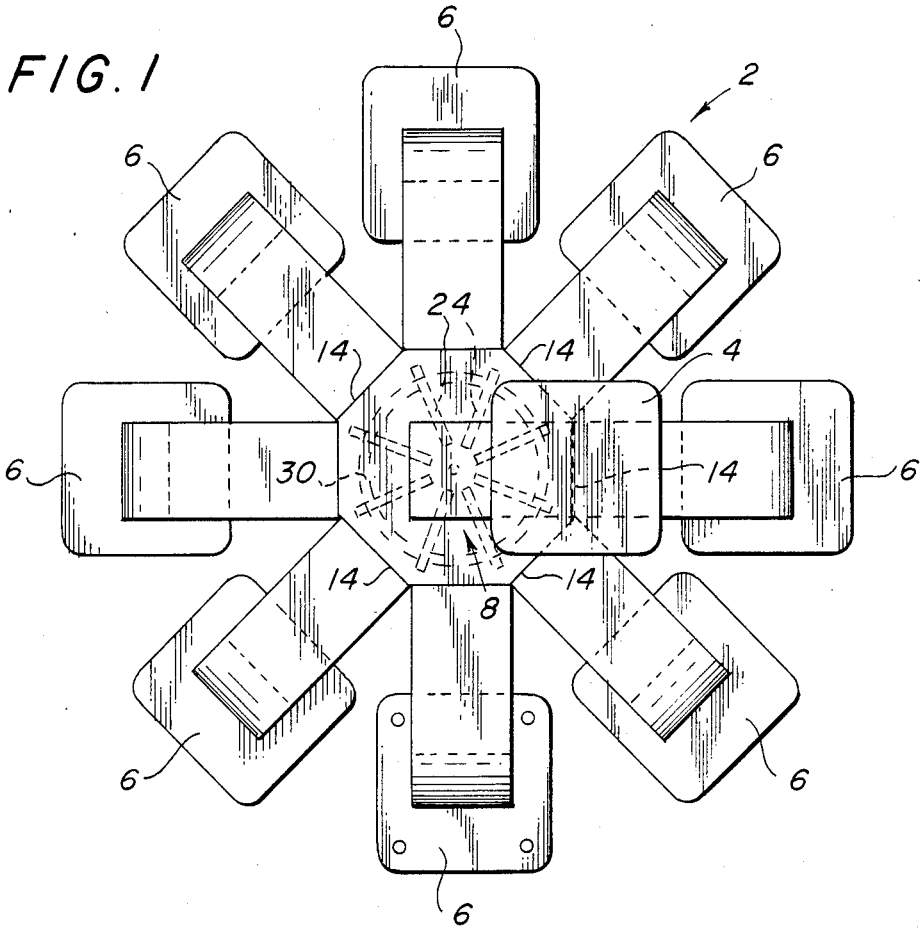
FIG. 1 is a top view of the H-plane stacked waveguide power divider/combiner according to one embodiment of the invention.
Figure 2:
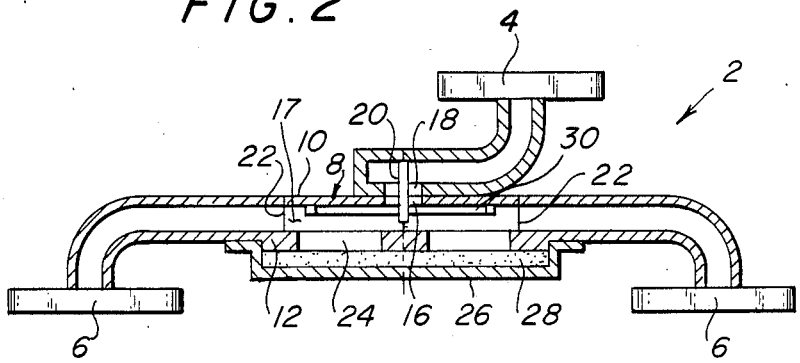
FIG. 2 is a side sectional view of the waveguide power divider/combiner of FIG. 1.
Figure 3:
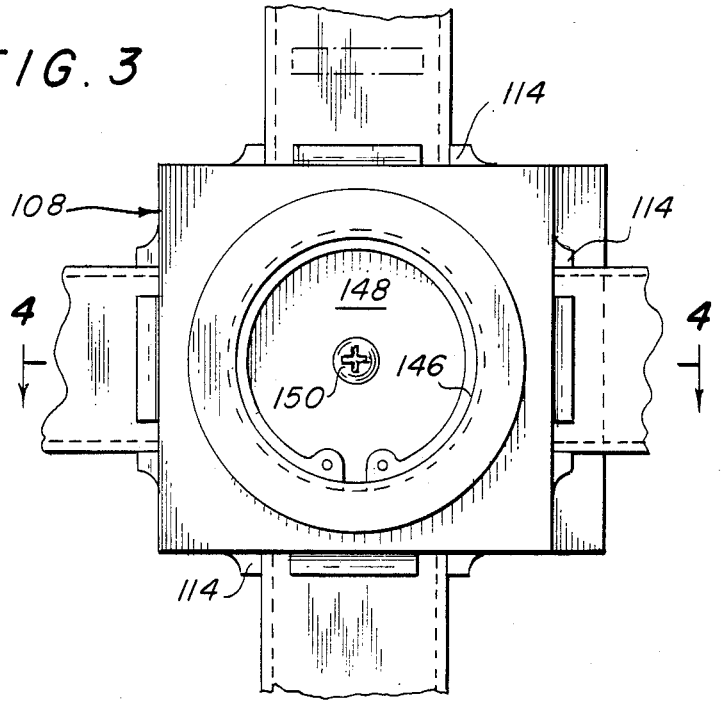
FIG. 3 is a bottom view of a radial waveguide according to an alternate preferred embodiment of the invention.

The compact waveguide power divider or combiner according to one embodiment of the invention is shown in FIGS. 1 and 2. When used as a power divider, the device 2 includes a rectangular input waveguide 4, a plurality of rectangular output waveguides 6, and a radial waveguide 8 arranged therebetween.

As shown in FIG. 2, the output, radial, and input waveguides are arranged in a vertically stacked configuration, thereby reducing the overall size of the device. Moreover, the output waveguides 6 are arranged in a circular array—as shown in FIG. 1—with their H-planes coplanar.

The radial waveguide 8 includes a top wall 10, a bottom wall 12, and a plurality of side walls 14 defining a chamber 17. The radial waveguide top wall 10 contains an inlet opening 16 centrally arranged relative to the side walls 14. The opening 16 affords communication with an opening 18 from the input waveguide 4. A coupling pin 20 is axially arranged within the radial waveguide chamber 17 and extends through the inlet opening 16 and the input waveguide opening 18 to couple the input waveguide 4 with the radial waveguide 8. In the desired mode of operation, the input waveguide 4 excites a TEM mode in the radial waveguide 8 which results in equal and in-phase excitation of the output waveguides 6.

As shown in FIG. 1, the radial waveguide 8 has a polygonal horizontal cross-sectional configuration. More particularly, the illustrated radial waveguide 8 has eight side walls 14, each side wall containing an outlet opening 22 affording communication between the radial waveguide chamber 17 and one of the eight output waveguides 6. The illustrated device is thus an eight-way power divider. Other polygonal radial waveguides may be provided depending upon the number of output waveguides. Thus an N-way divider would feed N waveguides and the radial waveguide 8 for such a device would include N sides.

A characterizing feature of the present invention is its ability to suppress or isolate undesirable modes. In the embodiment of FIGS. 1 and 2, the mode suppression device of the radial waveguide 8 comprises the bottom wall 12 thereof. More particularly, the radial waveguide bottom wall 12 contains a plurality of radial slots 24 corresponding with the outlet openings 22 in the side walls 14 of radial waveguide 8. As shown in FIG. 1, the slots 24 extend along lines between but short of the axial center of the radial waveguide 8 and the junction between two adjacent side walls 14. Arranged beneath the slotted bottom wall 12 of the radial waveguide 8 is a reservoir 26 containing a quantity of absorbing material 28 such as a resistive lossy material. The absorbing material 28 preferably comprises an epoxy based material loaded with particles of iron or carbon.

The radial slots 24 provide isolation among the output waveguides 6. More particularly, the thickness of the slotted bottom wall 12 of the radial waveguide 8 is approximately a quarter wavelength in order to transform the wave impedance of the lossy absorbing material 28 from about 100–150 ohms to about 1500 ohms. This results in high absorption for the undesired combiner modes, since these have circumferential currents in the radial waveguide 8.

In order to optimize the isolation characteristics of the mode suppression device, a tuning device is arranged within the chamber 17 of the radial waveguide 8. As shown in FIGS. 1 and 2, the tuning device may comprise a capacitive ring 30 coaxially arranged relative to the coupling pin 20. The ring 30 may be connected with either the top wall 10 or the bottom wall 12 of the radial waveguide 8. Tuning may also be provided by a circular array of capacitive tuning or matching pins (shown in FIG. 4) mounted in the radial waveguide 8 in place of the ring 30. Like the ring 30, the circular array of pins would be coaxially arranged relative to the coupling pin 20. Each pin would be centrally arranged relative to one of the output openings 22 of the radial waveguide 8 to maximize the isolation of undesired modes.

During operation, the desired mode experiences about a 1.4 VSWR at the junction between the output waveguides 6 and the radial waveguide 8. This junction can be matched separately, as can the junction between the radial waveguide 8 and the input rectangular waveguide 4. Because of the relatively small size of the radial waveguide region, the desired mode can be matched with a low VSWR and the isolation can be made greater than 13 dB over a six percent bandwidth and the dissipation loss is less than 0.5 dB.

An improved and thus preferred embodiment of the radial waveguide and mode suppression device is illustrated in FIGS. 3–7. For purposes of illustration, this embodiment is shown as a four-way waveguide power divider or combiner, although it could easily be constructed with any number of sides to provide an N-way device.

Figure 4:
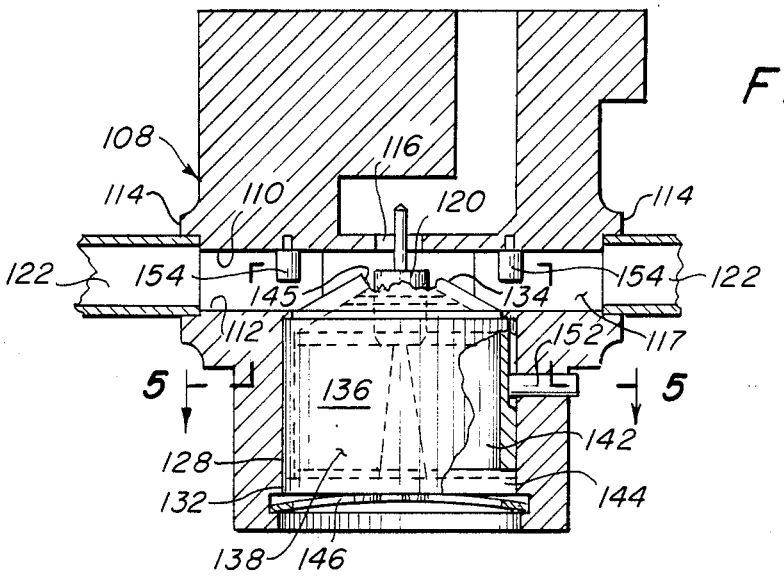
FIG. 4 is a front sectional view of the waveguide taken along line 4—4 of FIG. 3.

As shown in FIG. 4, the radial waveguide 108 includes a top wall 110, a bottom wall 112, and a plurality of side walls 114 defining a chamber 117. Like the radial waveguide 8 of the embodiment of FIG. 1, the top wall 110 contains an inlet opening 116 affording communication with an input waveguide (not shown). A coupling pin 120 is axially arranged within the radial waveguide chamber 117 and extends through the inlet opening 116. Each side wall 114 of the radial waveguide 108 contains an outlet opening 122 affording communication with the output waveguides (not shown).

The bottom wall 112 of the radial waveguide 108 contains a central opening 128 adapted to receive a mode suppression device 132. As shown more particularly in FIGS. 6*a* and 6*b*, the mode suppression device 132 includes a conical top wall 134 and a cylindrical side wall 136 defining a chamber 138. The mode suppression device 132 has an outer diameter corresponding with the diameter of the radial waveguide bottom wall opening 128, whereby the mode suppression device 132 is snug fit within the opening 128 with the conical top wall 134 extending into the radial waveguide chamber 117 as shown in FIG. 4. Moreover, the mode suppression device 132 is coaxially arranged relative to the radial waveguide 108. The mode suppression device top wall 134 contains a central opening 145 adapted to receive the coupling pin 120, with the lower portion of the pin 120 extending into the chamber 138 of the mode suppresion device 132. The conical top wall 134 also contains a plurality of radially arranged slots 141 each of which extend along a line between the center of the radial waveguide 108 and the junction between adjacent side walls 114 thereof. As will be developed in greater detail below, the slots 141 are at least partially filled with inserts 140 formed of fluorocarbon material.

Figure 5:
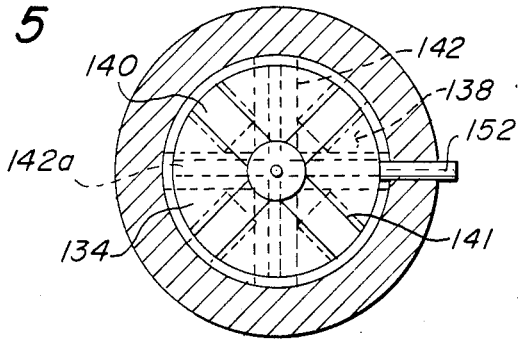
FIG. 5 is a top sectional view of the waveguide taken along line 5—5 of FIG. 4.

A spoked insert device 142 is arranged within the mode suppression chamber 138 as shown in FIG. 4. The insert 142 is shown in greater detail in FIGS. 7*a*–7*c* and includes a central portion 143 and a plurality of spokes 142*a* corresponding in number to the number of slots 141 contained in the top wall of the mode suppression device 132. The spokes 142*a* are preferably tapered toward the top wall 134 of the mode suppression device 132. The insert 142 is molded as a unitary structure from absorbing lossy material such as the material 28 in the embodiment of FIGS. 1 and 2. As shown in FIG. 5, the insert 142 is arranged in the chamber 138 with the spokes 142*a* between the fluorocarbon filled slots 141 of the conical top wall 134.

In order to hold the mode suppression device 132 and the insert 142 in place, a retainer 144 and a retaining clip 146 are provided at the base of the mode suppression device 132, which in turn are fixed by a cap 148 which is secured by a screw 150. A pin 152 passes through an opening in the radial waveguide 108 to engage the cylindrical wall 136 of the mode suppression device 132 to prevent the device 132 from rotating relative to the waveguide 108.

A circular array of tuning or matching pins 154 are arranged within the radial waveguide chamber 117 coaxially relative to the coupling pin 120. The pins 154 are preferably arranged on the center line of the outlet openings 122, respectively, to optimize isolation of undesired modes.

During operation, the undesired modes from the radial waveguide chamber 117 are directed to the slots 141 in the mode suppression top wall 134 by the tuning pins 154. The fluorocarbon inserts 140 within the slots 141 load the slots 141 so that undesirable wavelengths can propagate therethrough to the absorbing insert 142. The isolation characteristic of the absorber insert 142 can be tuned by varying the depth of insertion into the chamber 138 of the mode suppression device 132. Preferably, the insert 142 is fully inserted into the chamber 138 so that the top of the insert 142 is in contiguous relation with bottom of the coupling pin 120.

While the device according to the invention has been described as a power divider, it will be appreciated by those skilled in the art that the device may be used as a combiner by providing the output waveguides as the inputs to the radial waveguide and by providing the input waveguide as a single output.

While in accordance with the provisions of the Patent Statute the preferred forms and embodiments of the invention have been illustrated and described, it will be apparent to those skilled in the art that various changes and modifications may be made without deviating from the inventive concepts set forth above.

What is claimed is:

1. A compact waveguide power combiner/divider having low reflection and dissipation loss, comprising:

(a) a radial waveguide having a cylindrical wall and first and second opposing spaced apart walls coupled to the cylindrical wall for defining a chamber, the first wall having a central opening and the cylindrical wall having a plurality of respective arcuately spaced apart openings;

(b) a coupling pin axially arranged within said radial waveguide for coupling energy between the central opening and said radial waveguide;

(c) mode suppression means coupled to said radial waveguide and including a plurality of radially arranged slots, a respective one of the slots disposed between adjacent ones of the spaced apart openings, respectively, the mode suppression means for suppressing undesirable modes;

(d) tuning means connected to said radial waveguide for optimizing coupling of undesired modes with said slots; and (e) absorbing means coupled to said mode suppression means for absorbing undesired modes from said slots, whereby undesired modes are isloated from desired modes with low reflection and dissipation losses.

2. Apparatus as defined in claim 1, wherein said mode suppression means comprise the second wall of said radial waveguide.

3. Apparatus as defined in claim 1, wherein said tuning means comprises a capacitive ring coaxially arranged relative to said coupling pin.

4. Apparatus as defined in claim 1, wherein said tuning means comprise a plurality of capacitive matching pins coupled to the radial waveguide and arranged in a circular array coaxial with said coupling pin.

5. Apparatus as defined in claim 4, wherein a respective one of the matching pins is centrally arranged with respect to respective ones of the spaced apart openings.

6. Apparatus as defined in claim 1, and further comprising a central rectangular waveguide coupled to said central opening and a plurality of rectangular waveguides coupled to said spaced apart openings, respectively.

7. Apparatus as defined in claim 6, wherein said plurality of waveguides, said radial waveguide, and said central rectangular waveguide are arranged in a stacked configuration.

8. Apparatus as defined in claim 6, wherein said plurality of waveguides are arranged in a circular array with coplanar H-planes.

9. Apparatus as defined in claim 8, wherein said coupling pin extends through said central opening and into said central waveguide.

10. Apparatus as defined in claim 9, wherein said radial waveguide includes a plurality of side walls having a polygonal cross-sectional configuration, one of said spaced apart openings being arranged in each side wall of said radial waveguide.

11. Apparatus as defined in claim 10, wherein said slots each extend along a respective line between the center of said radial waveguide and the junction between adjacent side walls of said radial waveguide.

12. Apparatus as defined in claim 11, wherein said slots have a thickness of approximately a quarter wavelength.

13. Apparatus as defined in claim 12, wherein said absorbing means comprises lossy material disposed in energy flow communication with the slots.

14. Apparatus as defined in claim 10, wherein the second wall includes a central opening, said mode suppression means being arranged in said central opening of the second wall and including a conical top wall portion containing a central opening adapted to receive said coupling pin and said plurality of radially arranged slots each extending along a line between the center of said radial waveguide and the junction between adjacent side walls of said radial waveguide.

15. Apparatus as defined in claim 14, wherein said mode suppression means further includes a cylindrical side wall for defining a suppression chamber coupled to said conical top wall.

16. Apparatus as defined in claim 15, wherein said absorbing means further comprises a spoked insert member molded from lossy material and arranged in said suppression chamber, the spokes of said insert member corresponding in number with and extending radially between said slots, respectively, for absorbing undesired modes from said slots.

17. Apparatus as defined in claim 16, wherein each of said slots is at least partially filled with fluorocarbon material for propagating undesired modes through said slots to said insert member.

18. Apparatus as defined in claim 17, wherein said tuning means comprise a plurality of matching capacitive pins coupled to the radial waveguide and arranged in a circular array coaxial with said coupling pin.

19. Apparatus as defined in claim 18, wherein a respective one of the matching pins is centrally arranged with respect to respective ones of the spaced apart openings.

* * * * *